US010869562B1

(12) United States Patent
Bryan

(10) Patent No.: US 10,869,562 B1
(45) Date of Patent: Dec. 22, 2020

(54) ADJUSTABLE HEIGHT SHELF DIVIDERS

(71) Applicant: Douglas C Bryan, Seattle, WA (US)

(72) Inventor: Douglas C Bryan, Seattle, WA (US)

( * ) Notice: Subject to any disclaimer, the term of this patent is extended or adjusted under 35 U.S.C. 154(b) by 0 days.

(21) Appl. No.: 15/972,864

(22) Filed: May 7, 2018

(51) Int. Cl.
*A47F 5/00* (2006.01)
*A47B 45/00* (2006.01)
*A47B 57/58* (2006.01)
*A47B 65/00* (2006.01)

(52) U.S. Cl.
CPC ..... *A47F 5/005* (2013.01); *A47B 45/00* (2013.01); *A47B 57/58* (2013.01); *A47B 57/583* (2013.01); *A47B 65/15* (2014.12)

(58) Field of Classification Search
CPC ..... A47F 5/005; A47F 5/132; A47F 7/144; A47B 57/58; A47B 65/00; A47B 57/583; A47B 57/585; A47B 57/586; A47B 57/588; A47B 65/10; A47B 65/15; A47B 96/04; A47B 45/00; A47L 15/504
USPC ..... 211/184, 43, 175, 42; 108/60, 61; 220/500; 206/529, 534, 561; 248/227.1, 248/227.4, 235
See application file for complete search history.

(56) References Cited

U.S. PATENT DOCUMENTS 4,243,227 A * 1/1981 Strongin ..... A63F 9/02 273/126 R
4,889,253 A * 12/1989 Schmulian ..... A45C 13/02 220/551
5,458,248 A * 10/1995 Alain ..... A47B 45/00 211/153
5,562,217 A * 10/1996 Salveson ..... A47F 1/126 211/175
5,584,405 A * 12/1996 Tunzi ..... A47B 45/00 108/137
5,638,963 A * 6/1997 Finnelly ..... A47F 1/125 211/59.3
5,657,878 A * 8/1997 Austin ..... A47L 15/504 211/208
5,685,664 A * 11/1997 Parham ..... A47F 1/126 403/393
5,860,716 A * 1/1999 Good ..... A47L 15/504 312/311
6,142,317 A * 11/2000 Merl ..... A47F 1/125 211/184
6,409,027 B1 * 6/2002 Chang ..... A47F 1/126 211/184
6,830,157 B2 * 12/2004 Robertson ..... A47F 1/126 211/59.3
6,886,700 B2 * 5/2005 Nagel ..... A47F 1/126 211/184
6,955,269 B2 * 10/2005 Menz ..... A47F 1/125 211/51
6,974,040 B2 * 12/2005 Jahrling ..... A47L 15/504 211/175

(Continued)

*Primary Examiner* — Jennifer E. Novosad
(74) *Attorney, Agent, or Firm* — Mark S. Hubert

(57) ABSTRACT

A shelf divider that is vertically and horizontally adjustable. It has a base portion that slidingly adjusts along the length of a commercial shelf and supports a vertical blade. The vertical blade may be of different fixed heights, an incrementally adjustable height or a multiple stackable blade array height. The incrementally adjustable height embodiment utilizes a pair of matingly engageable vertical blades that are positioned with respect to each other to achieve the desired height and locked into position with a ratchet locking system.

6 Claims, 13 Drawing Sheets

(56) References Cited

U.S. PATENT DOCUMENTS

| | | | | |
|---|---|---|---|---|
| 7,028,852 | B2 * | 4/2006 | Johnson | A47F 1/126 108/60 |
| 7,163,119 | B2 * | 1/2007 | Besselman | A47B 96/04 220/534 |
| 7,681,746 | B2 * | 3/2010 | Schmidt | A47F 5/005 211/184 |
| 8,556,092 | B2 * | 10/2013 | Valiulis | A47F 5/005 108/61 |
| 9,265,358 | B2 * | 2/2016 | Hardy | A47B 57/588 |
| 9,351,590 | B1 * | 5/2016 | Wildrick | A47F 5/0056 |
| 9,591,923 | B2 * | 3/2017 | Zeidner | A47B 57/588 |
| 9,700,156 | B1 * | 7/2017 | Hance | A47B 57/583 |
| 9,901,191 | B1 * | 2/2018 | Schmidt | A47F 1/125 |
| 2007/0120452 | A1 * | 5/2007 | Benz | F25D 25/02 312/400 |
| 2010/0089847 | A1 * | 4/2010 | Rataiczak, III | A47F 1/126 211/59.3 |
| 2012/0082507 | A1 * | 4/2012 | Wong | A47L 15/504 403/17 |
| 2012/0111764 | A1 * | 5/2012 | Lackey | A47F 5/005 206/736 |
| 2013/0248475 | A1 * | 9/2013 | Erickson | A47F 5/005 211/119.003 |
| 2015/0257533 | A1 * | 9/2015 | Yang | A47K 1/09 220/4.01 |
| 2017/0119178 | A1 * | 5/2017 | Markwick | A47K 10/18 |
| 2017/0318985 | A1 * | 11/2017 | Collette | A47F 5/005 |

* cited by examiner

ADJUSTABLE HEIGHT SHELF DIVIDERS

COPYRIGHT STATEMENT

A portion of the disclosure of this patent document contains material that is subject to copyright protection. The copyright owner has no objection to the facsimile reproduction by anyone of the patent document or the patent disclosure as it appears in the Patent and Trademark Office patent file or records, but otherwise reserves all copyright rights whatsoever.

FIELD

The present disclosure relates, in general, to commercial shelving, and more particularly to adjustable height moveable shelf dividers.

BACKGROUND

Most retail and wholesale distributors and sellers must warehouse some level of inventory. This generally occurs at or near their operative location. Frequently this will be in an urban area where real estate prices are high, so it makes good business sense to keep the warehouse as small as possible. To accomplish this requires extreme organization and an array of vertical storage units. Costco Inc. is a master at maintaining a small footprint by using such systems. However, there must also be a method of horizontal organization to integrate with this vertical storage structure. In most retail warehouses this is accomplished with shelving.

Since inventory of any particular item shrinks and grows, more or less of them may be stored on the shelving. When there is a small number of the item it should be able to share horizontal space on the shelf with other items. When there is a large number of the item it should be able to stacked vertically on the shelf without having to expand its relegated horizontal storage area or force other items to be moved from that shelf. Current retail storage shelving systems do not perform this function. When more items are stacked onto a shelf they spill over into the other items or tumble off the shelf. A system that adjusts segregated shelf space both horizontally and vertically would solve this dilemma.

Henceforth, an adjustable height shelf divider that may segregate a shelf both horizontally and vertically would fulfill a long felt need in the retail industry. This new invention utilizes and combines known and new technologies in a unique and novel configuration to overcome the aforementioned problems and accomplish this.

BRIEF SUMMARY

In accordance with various embodiments, a horizontally adjustable and vertically adjustable shelf divider is provided. The vertical adjustment may be in fixed increments or in variable adjustable increments accomplished by replacement of the primary blade, addition of secondary blades or the incremental movement of a twin blade array.

Various modifications and additions can be made to the embodiments discussed without departing from the scope of the invention. For example, while the embodiments described above refer to particular features, the scope of this invention also includes embodiments having different combination of features and embodiments that do not include all of the above described features.

BRIEF DESCRIPTION OF THE DRAWINGS

A further understanding of the nature and advantages of particular embodiments may be realized by reference to the remaining portions of the specification and the drawings, in which like reference numerals are used to refer to similar components.

DETAILED DESCRIPTION OF CERTAIN EMBODIMENTS

While various aspects and features of certain embodiments have been summarized above, the following detailed description illustrates three exemplary embodiments in further detail to enable one skilled in the art to practice such embodiments. The described examples are provided for illustrative purposes and are not intended to limit the scope of the invention.

In the following description, for the purposes of explanation, numerous specific details are set forth in order to provide a thorough understanding of the described embodiments. It will be apparent to one skilled in the art, however, that other embodiments of the present invention may be practiced without some of these specific details. Three embodiments are described herein, and while various features are ascribed to different embodiments, it should be appreciated that the features described with respect to one embodiment may be incorporated with other embodiments as well. By the same token, however, no single feature or features of any described embodiment should be considered essential to every embodiment of the invention, as other embodiments of the invention may omit such features.

Unless otherwise indicated, all numbers herein used to express quantities, dimensions, and so forth, should be understood as being modified in all instances by the term "about." In this application, the use of the singular includes the plural unless specifically stated otherwise, and use of the terms "and" and "or" means "and/or" unless otherwise indicated. Moreover, the use of the term "including," as well as other forms, such as "includes" and "included," should be considered non-exclusive. Also, terms such as "element" or "component" encompass both elements and components comprising one unit and elements and components that comprise more than one unit, unless specifically stated otherwise.

As used herein, the term "vertical" refers to the ZY or ZX plane defined by Cartesian coordinate system and the term "horizontal" refers to the XY plane defined by Cartesian coordinate system.

The present invention relates to a novel design for a horizontally and vertically adjustable shelf divider. It is constructed through injection molding with a suitable polymer. Its blade configurations are both corrugated for strength and have open cell arrays formed there through to remove unnecessary material and lighten the overall mass.

Figure 1:
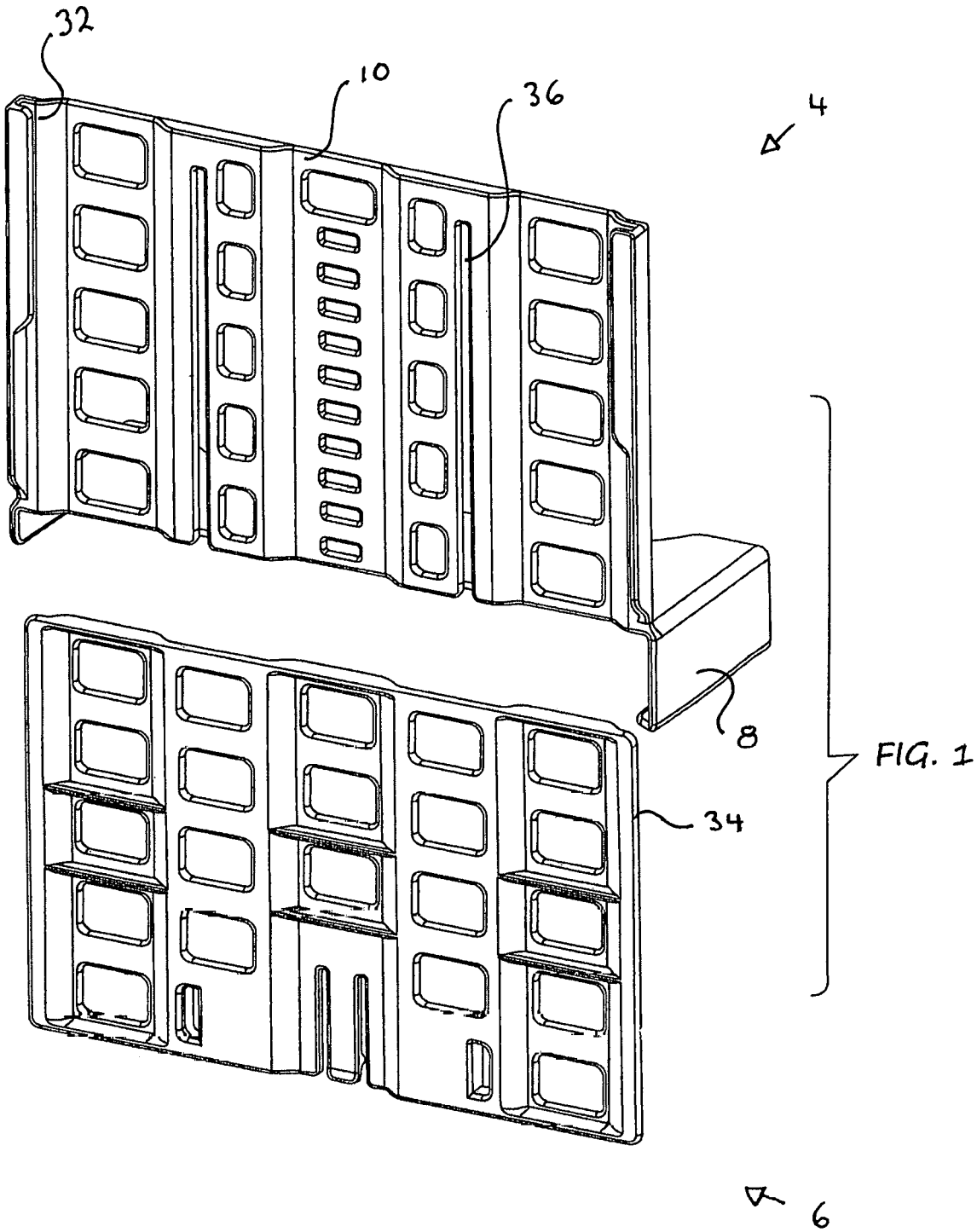
FIG. 1 is an exploded rear perspective view of the first embodiment shelf divider.
Figure 2:
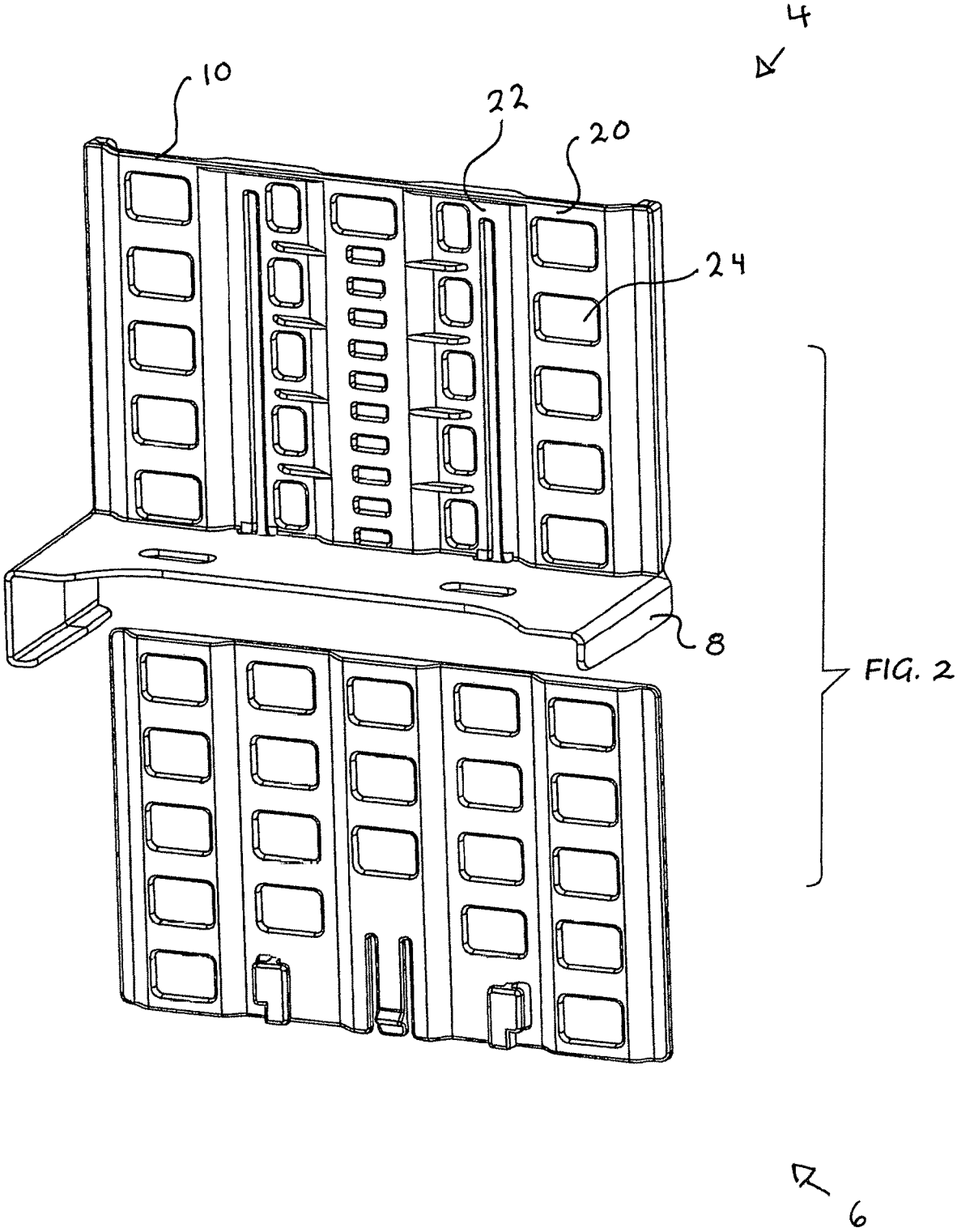
FIG. 2 is an exploded front perspective view of the first embodiment shelf divider.
Figure 3:
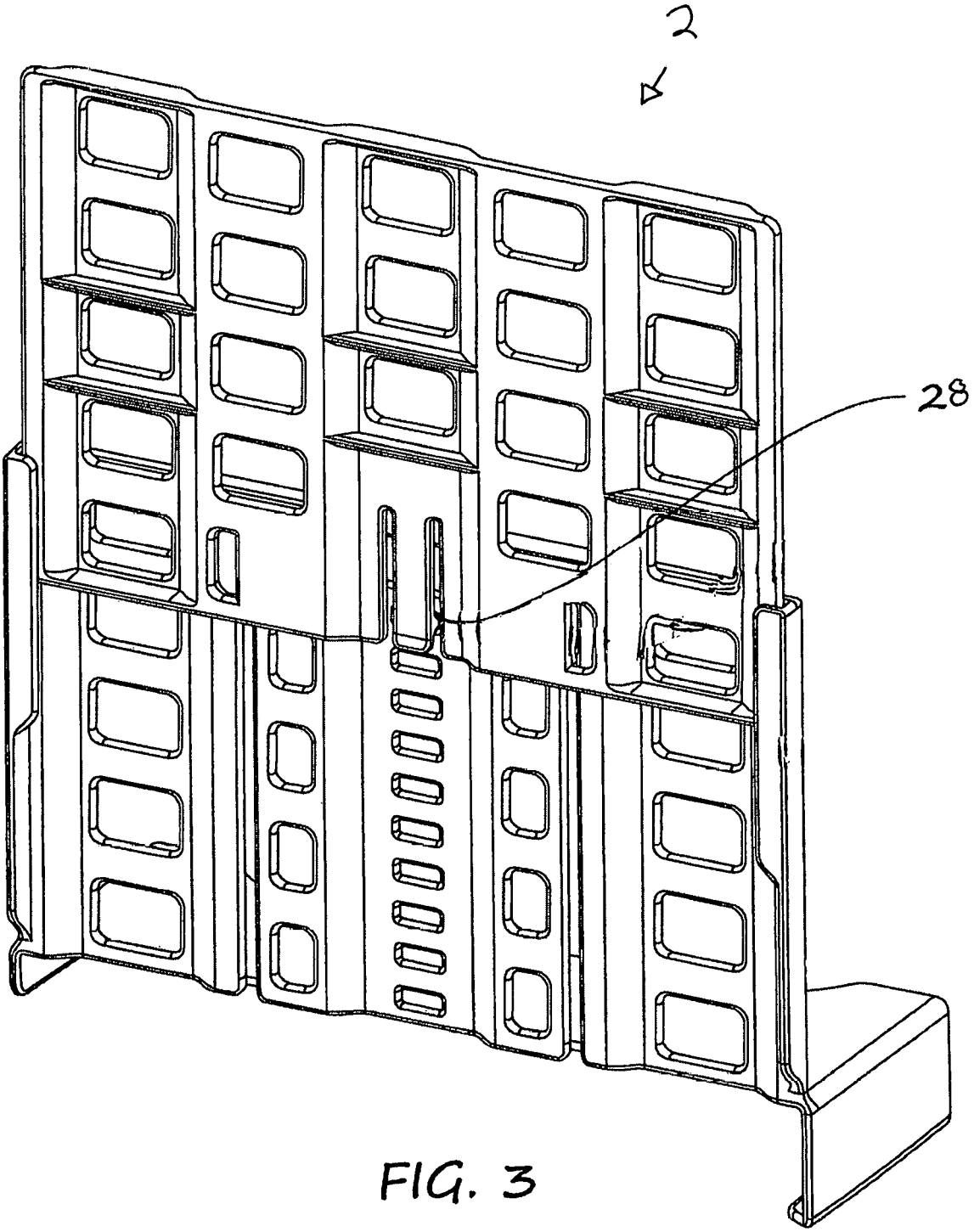
FIG. 3 is a rear perspective view of the first embodiment shelf divider in a partially raised configuration.
Figure 4:
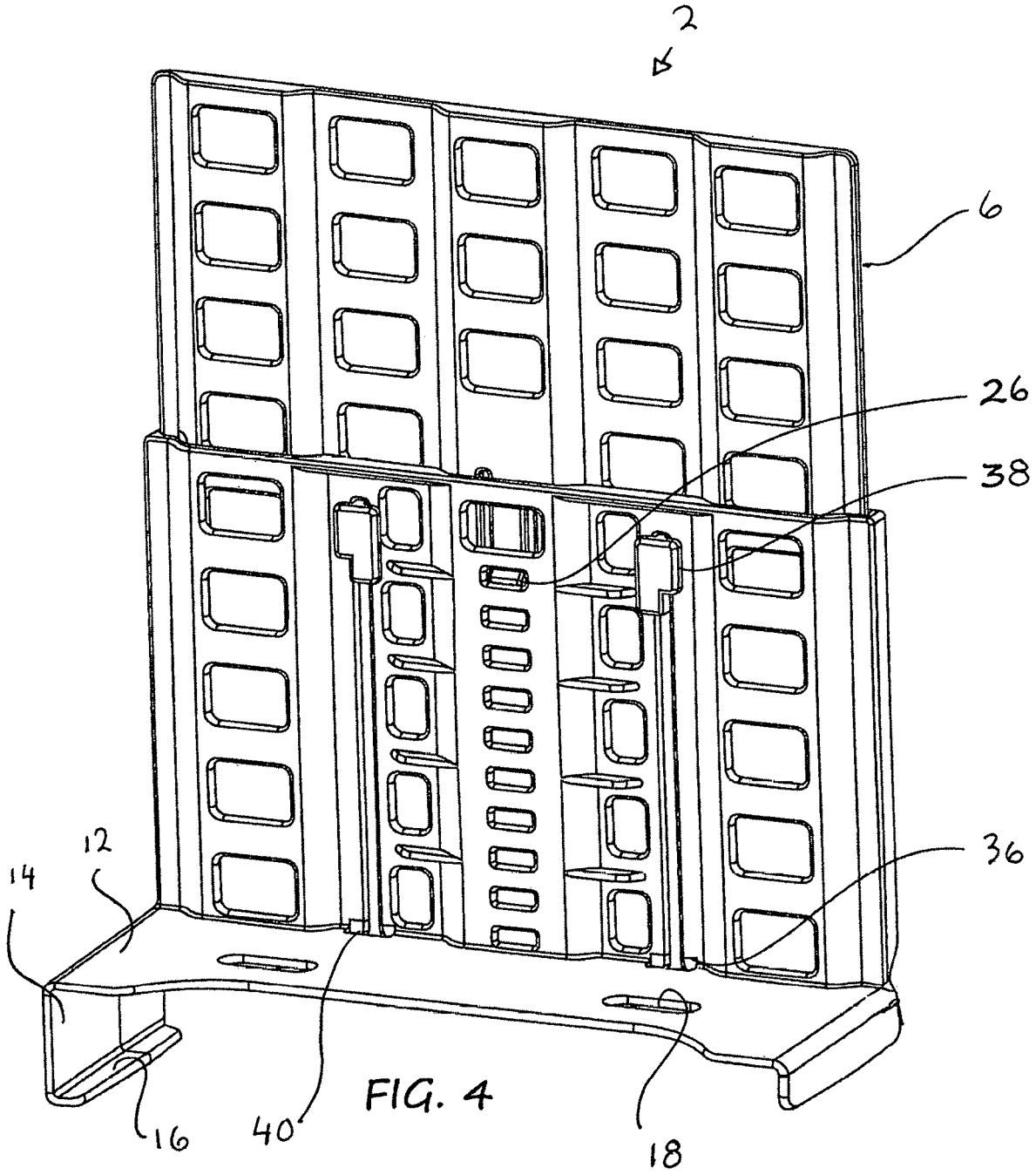
FIG. 4 is a front perspective view of the first embodiment shelf divider in a partially raised configuration.
Figure 5:
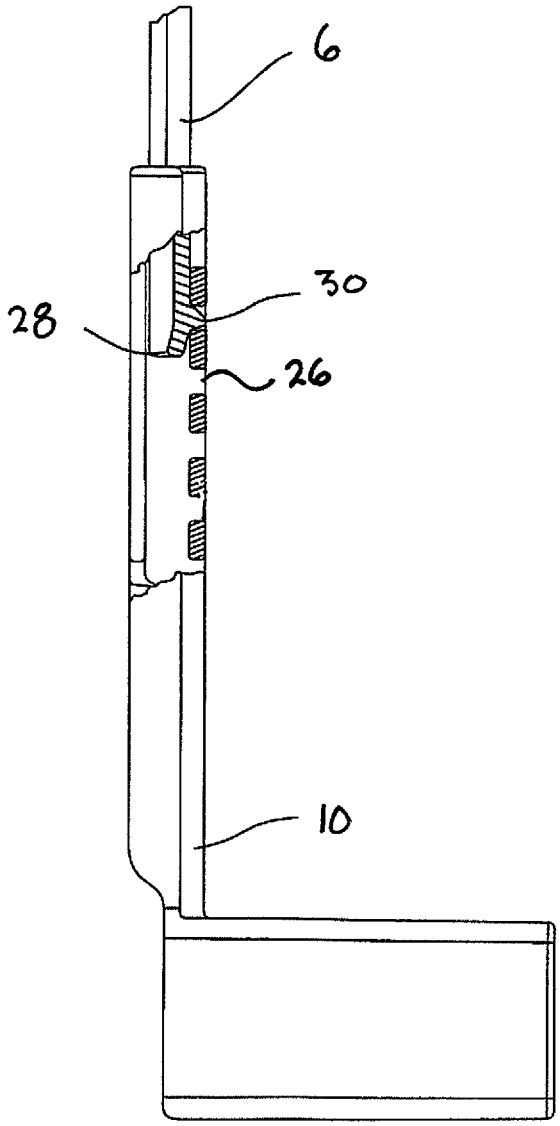
FIG. 5 is a partial cutaway, cross sectional side view of the first embodiment shelf divider.
Figure 6:
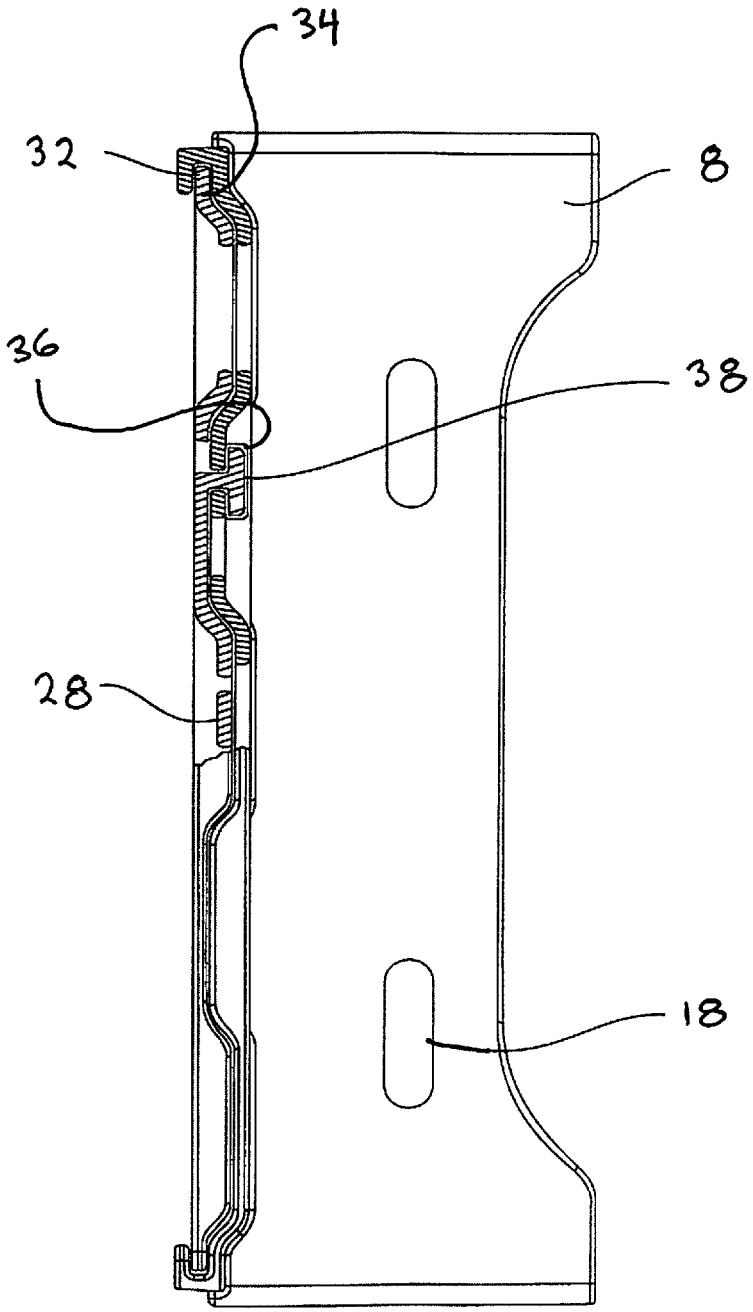
FIG. 6 is partial cutaway, cross sectional top view of the first embodiment shelf divider.

FIGS. 3-6 illustrate that the adjustable height shelf divider 2 when assembled, is a unitary shelf divider that retains its vertical extension upper blade 6 behind its lower blade 10 in its lowered configuration, always at the ready for incremental adjustments in height. Looking at FIGS. 1 to 3 it can be seen that the adjustable height shelf divider 2 (first and preferred embodiment shelf divider) has a lower blade base assembly 4 and a vertically adjustably upper blade 6. The lower blade base assembly 4 has a slidingly adjustable horizontal shelf bracket 8 and a lower blade 10 which extends perpendicularly from the rear edge of the top face of the lower blade 10. As can be seen in FIGS. 3, 4 and 5, the upper blade 6 of the adjustable height shelf divider 2 may be vertically positioned in a lowered configuration or any of an incrementally, vertically adjustable, raised configuration. When in the lowered configuration the lower blade 10 and the upper blade 6 reside adjacent each other in a parallel, corrugated configuration as is best illustrated in the horizontal cross section of FIG. 6.

Looking at FIG. 4, the lower blade base assembly 4 is a C shaped bracket that has a top face 12 that spans across the top of a shelf, two side arms 14 that extend perpendicularly from the opposing short edges of the top face and extend across the shelf sides for the thickness of the shelf, and two return flanges 16 that extend perpendicularly from the bottom edge of the side arms 14 so as to extend partially along the bottom face of the shelf. In this fashion, the lower blade base assembly 4 curves around a matingly conformed shelf, and holds the lower blade 10 perpendicular to the top surface of the shelf.

Although not illustrated, as it forms no part of this invention, the shelf is a planar member generally rectangular or C shaped in cross section. The dimensional tolerances between the shelf and the lower blade base assembly 4 are such as to allow the horizontal sliding of the lower blade base assembly 4 along the shelf for horizontal positioning along the depth of the shelf. On the shelf are rows of oval orifices that matingly align with a pair of slots 18 formed through the top face 12. The adjustable height shelf divider 2 may be horizontally slid along the shelf to a specified depth until the slots 18 align with the orifices and a pair of locking pegs inserted there through to lock the vertical position of the adjustable height shelf divider 2. The locking pegs have low profile heads.

In the preferred embodiment, the shelf bracket 8 and lower blade 10 are a single piece although in alternate embodiments these may be fabricated in separated pieces and joined. The lower blade 10 is vertically corrugated having alternating series of vertical ridges 20 and grooves 22 each of which have an array of open cells 24 formed there through. The upper blade 6 has a matingly engageable vertical corrugated configuration although its arrays of open cells may have different dimensions that that of the lower blade 10.

The lower blade 10 has a series of linear ratchet slots 26 formed vertically along its centerline that matingly are engaged by a bendable ratchet tooth 28 located on the vertical centerline of the upper blade 6 at the bottom edge of the upper blade 6. Looking at FIG. 5 it can be seen that the ratchet tooth 28 has a linear, planar strip body attached at its top end to the upper blade 6 and free to flex horizontally at its bottom end. It has a tab 30 extending from its front face adjacent its bottom end that engages the ratchet slots 26 so as to lock the vertical position of the upper blade 6 relative to the lower blade 10. The bottom end of the ratchet tooth 28 is angled slightly from the vertical plane of the ratchet tooth body to allow for a tactile ratchet disengagement manipulation.

There are four mechanisms that connect the upper blade 6 to the lower blade 10 and allow for their aligned sliding vertical engagement. (Reference FIGS. 1 and 6.) First, the lower blade 10 has a pair of vertical retention grooves 32 formed continuously along its left and right vertical edges. The upper blade 6 has matingly conformed right and left vertical slide edges 34 with a thickness that allows for sliding engagement of these side edges 34 of the upper blade 6 within the pair of retention grooves 32 of the lower blade 10. Second there are two parallel vertical slots 36 formed from the bottom of the lower blade to just short of the top edge of the lower blade 10. The upper blade 6 has a pair of T shaped tabs 38 that extend perpendicularly from its vertical front face. (See FIG. 4.) The head of the T shaped tab 38 is passed through an entry orifice 40 formed through the horizontal shelf bracket 8 where the vertical slots 36 of the lower blade 10 meet the shelf bracket 8. (Although it is known that in alternate embodiments only one T shaped tab and one parallel vertical slot may be used.) This entry orifice is wide enough to allow the head of the T shaped tab 38 to pass however the width of the vertical slots 36 is too narrow for the T shaped tab to exit. In this way, the largest part of the T shaped tab 38 is constrained on the front side of the lower blade 10 while the remainder of the upper blade 6 is constrained on the back side of the lower blade 10. This allows the upper blade 6 to be vertically adjusted while in parallel alignment with the lower blade 10 but the two blades constrained from separation by the left and right vertical retention grooves 32 and the T shaped tabs 38. Third, the engagement of the bendable ratchet tooth 28 in the vertical linear ratchet slots 26 serves to lock the upper blade 6 at the desired height. Fourth, the matching corrugation configurations of the upper blade and the lower blade allow the vertical faces of the two blades to be matingly engaged such that they remain parallel and adjacent throughout the vertical positioning of the lower blade, therein resisting horizontal separation and keeping the blades aligned.

Figure 7:
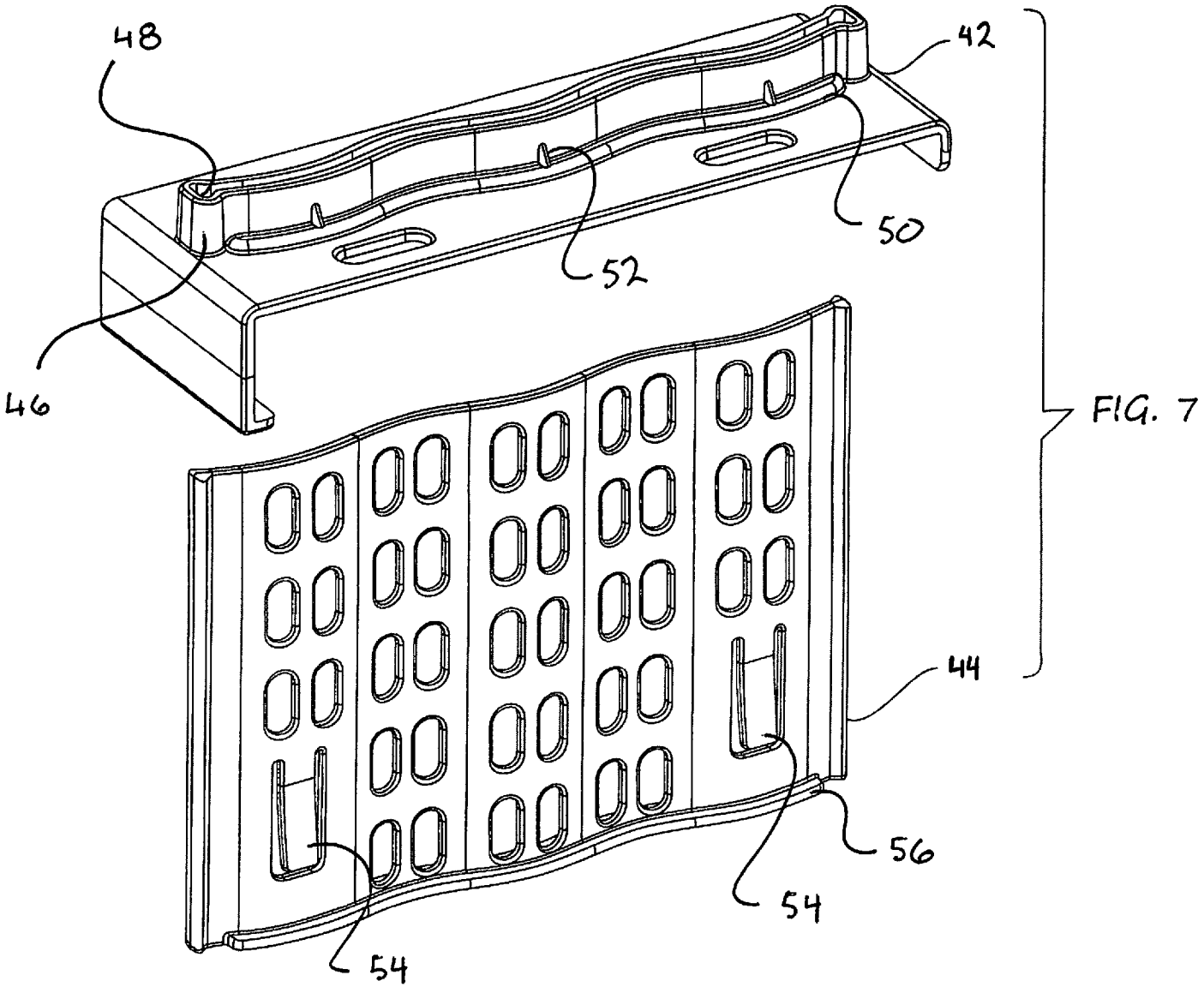
FIG. 7 is an exploded front perspective view of the second embodiment shelf divider.
Figure 8:
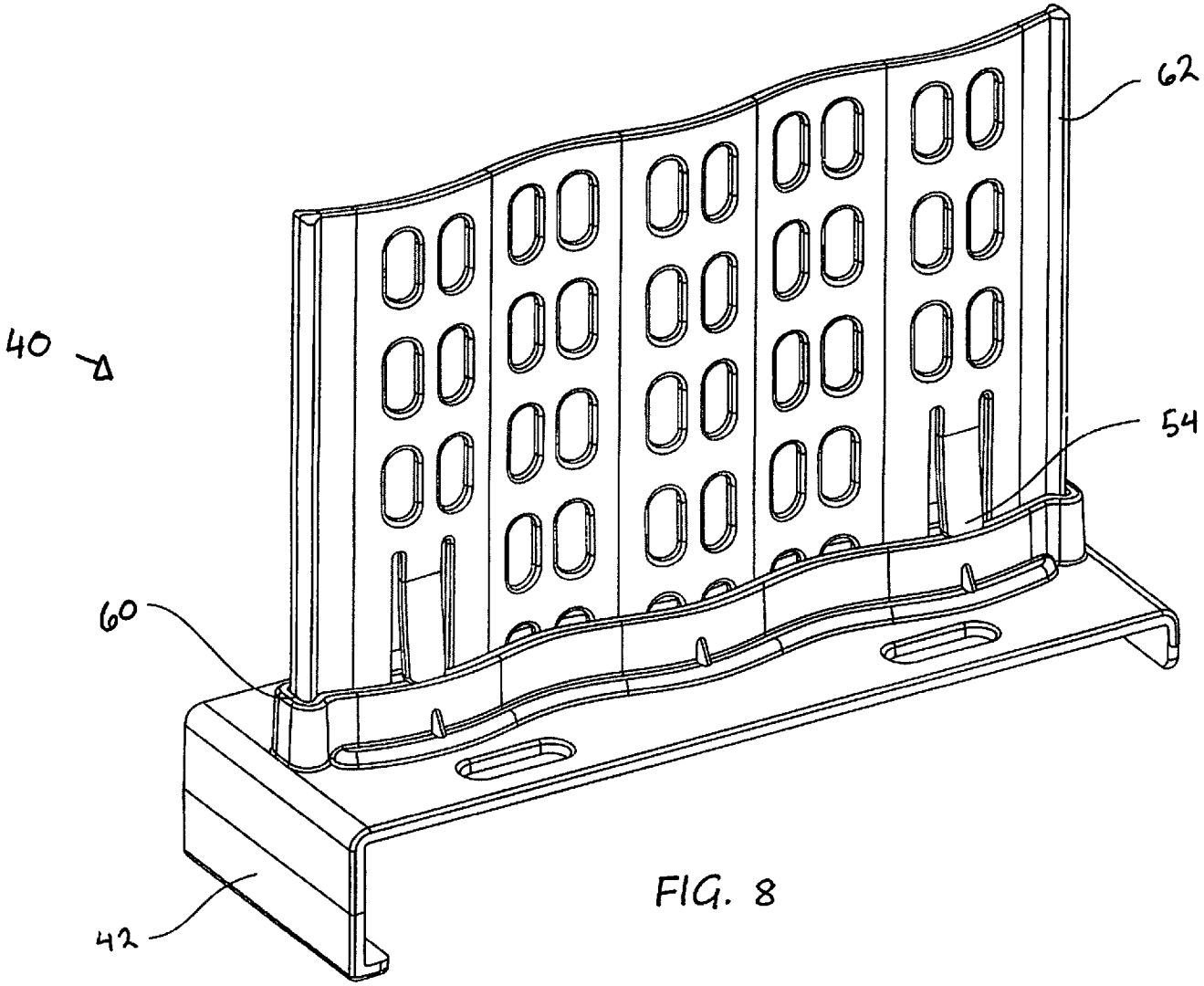
FIG. 8 is a front perspective view of the assembled second embodiment shelf divider.
Figure 9:
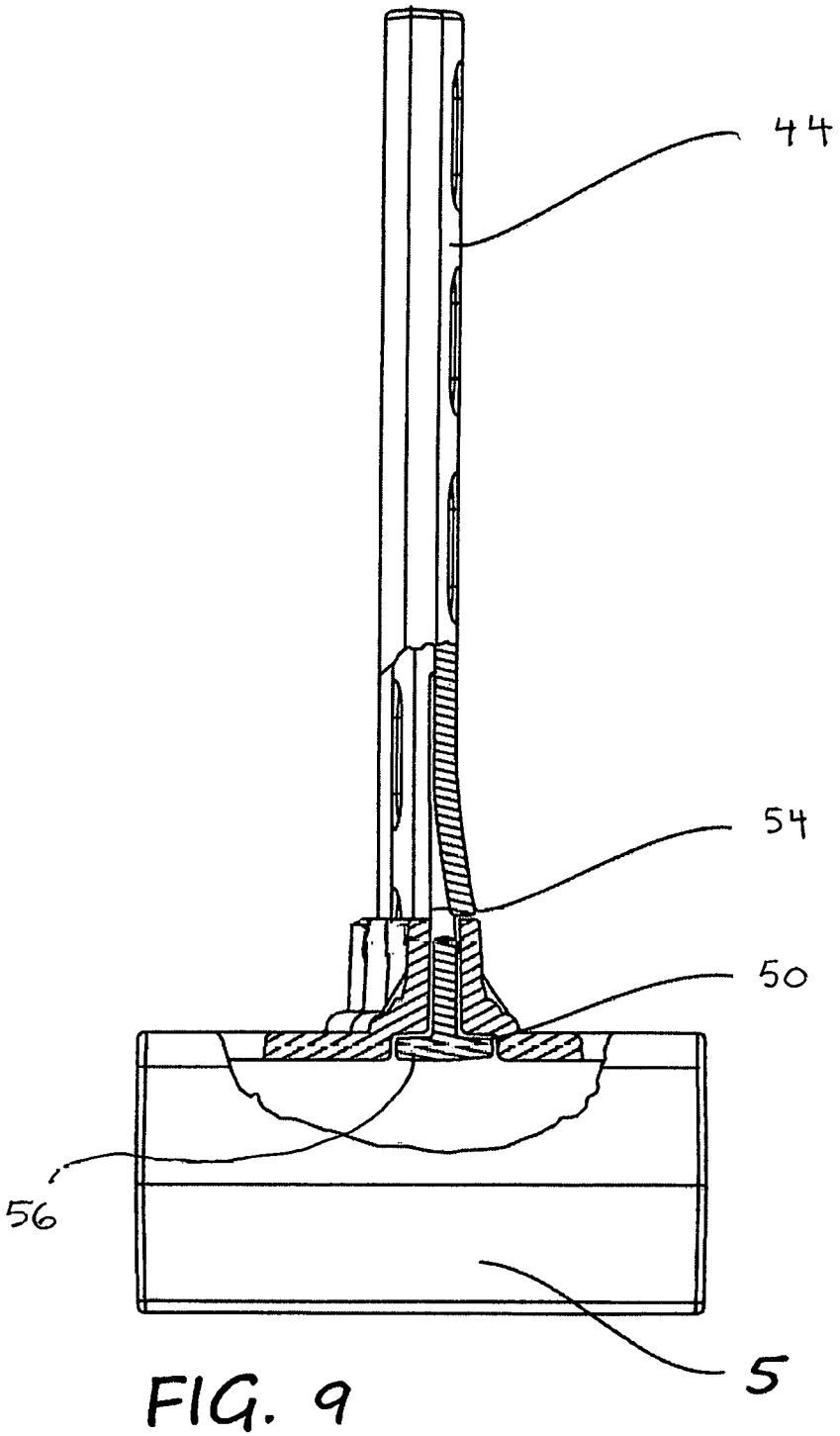
FIG. 9 is a partial cutaway, cross sectional side view of the second embodiment shelf divider.
Figure 10:
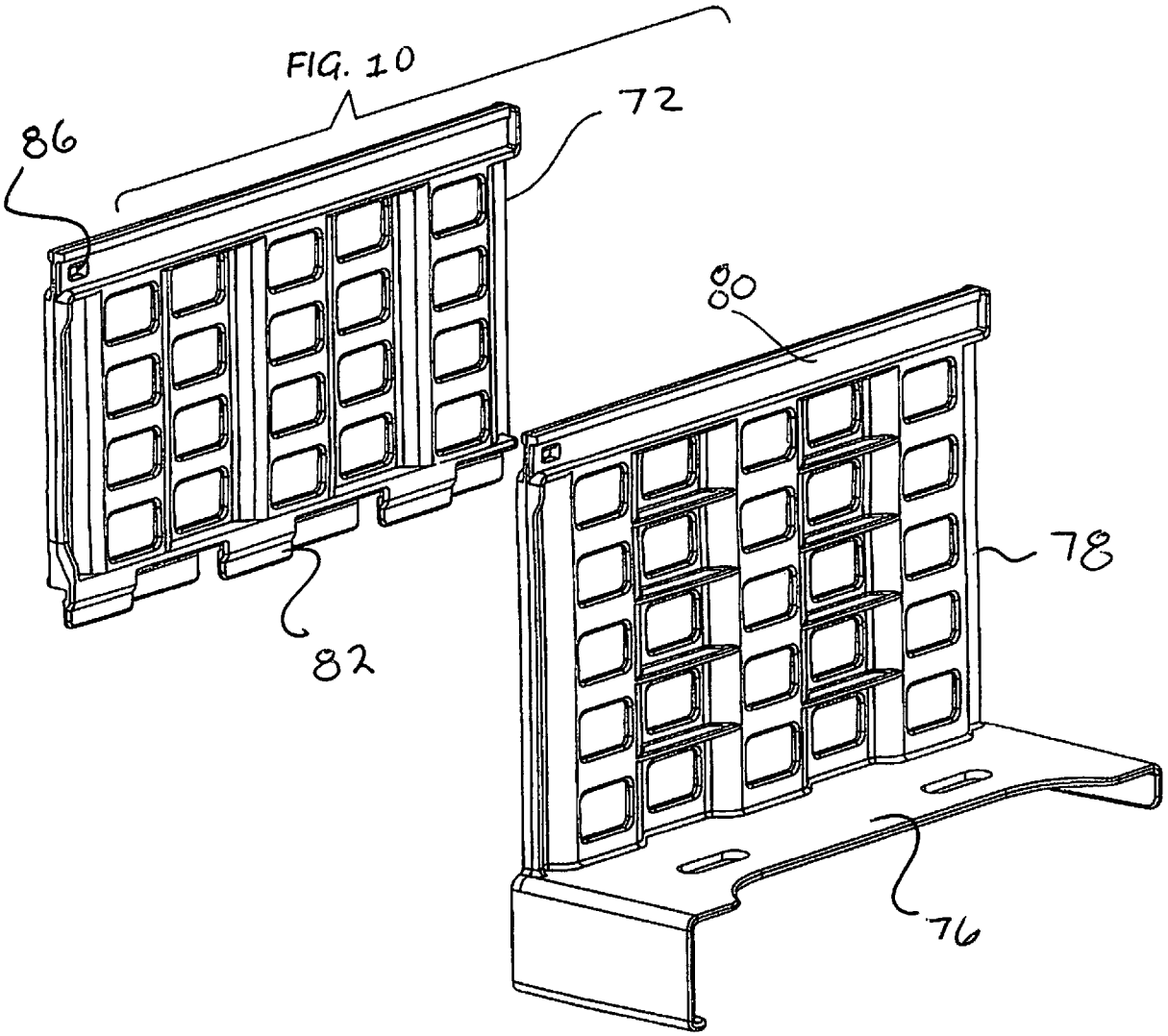
FIG. 10 is an exploded front perspective view of the third embodiment shelf divider.
Figure 11:
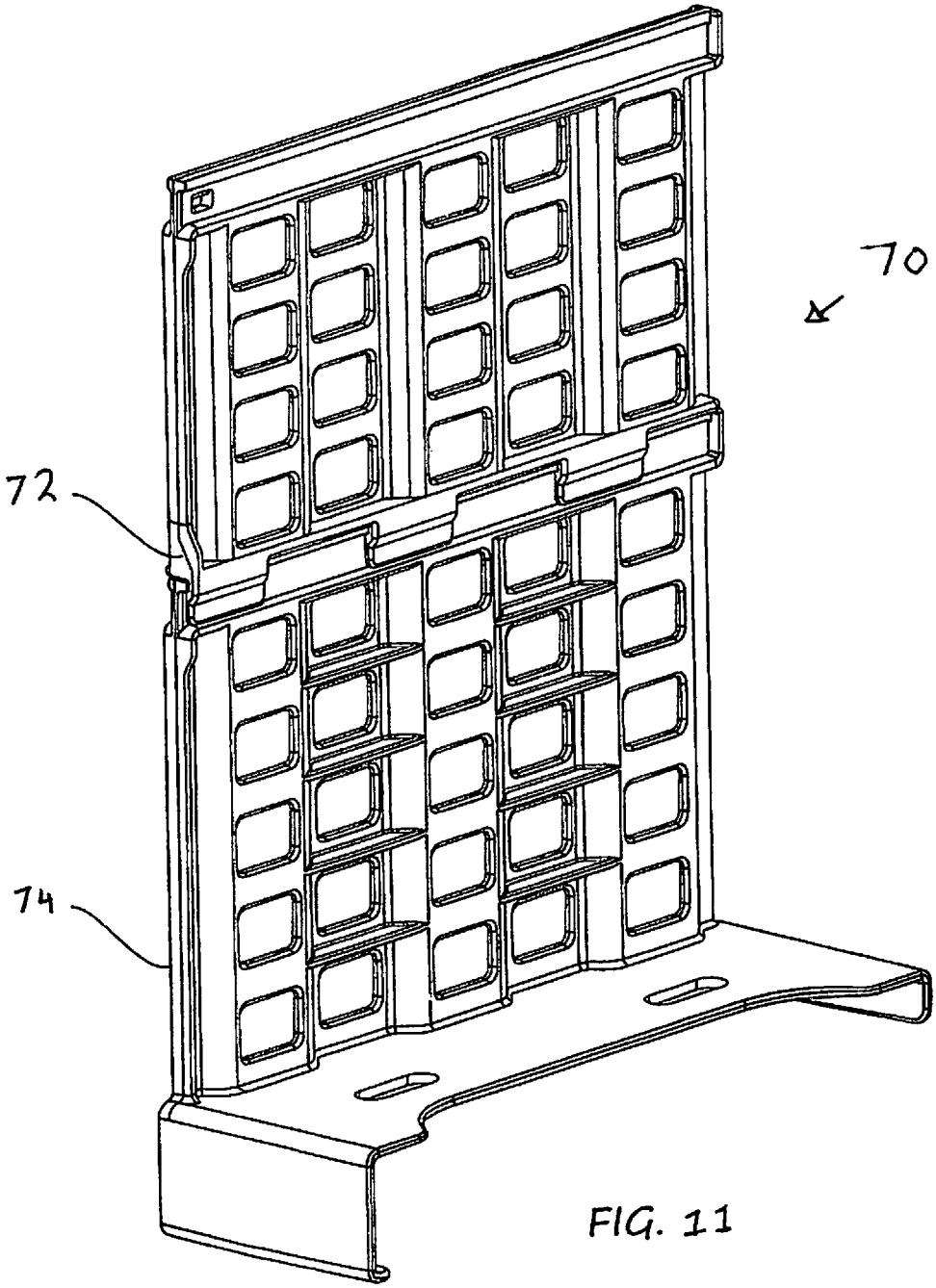
FIG. 11 is an assembled front perspective view of the third embodiment shelf divider.
Figure 12:
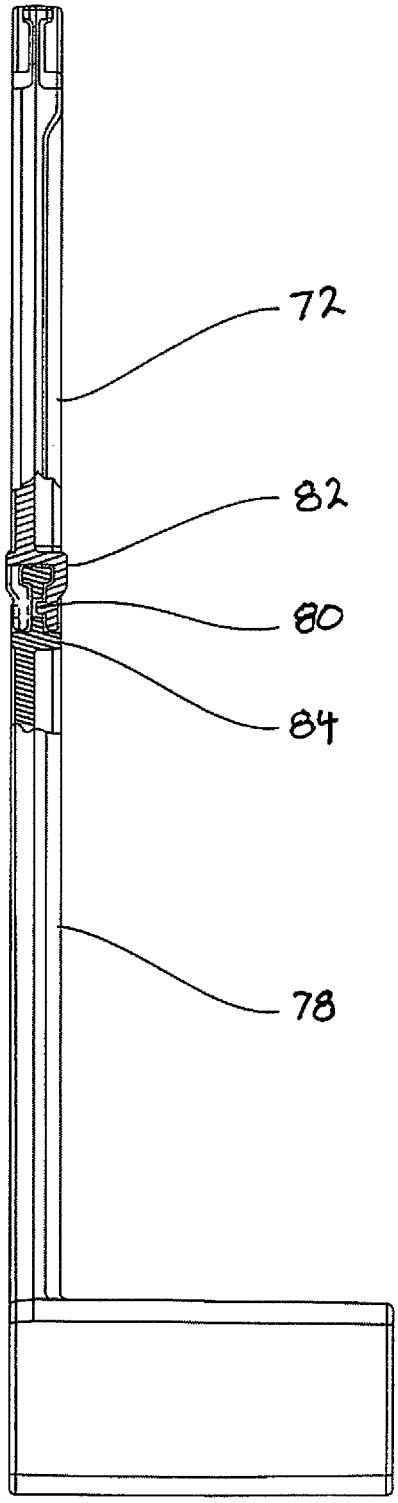
FIG. 12 is a partial cutaway, cross sectional side view of the third embodiment shelf divider.
Figure 13:
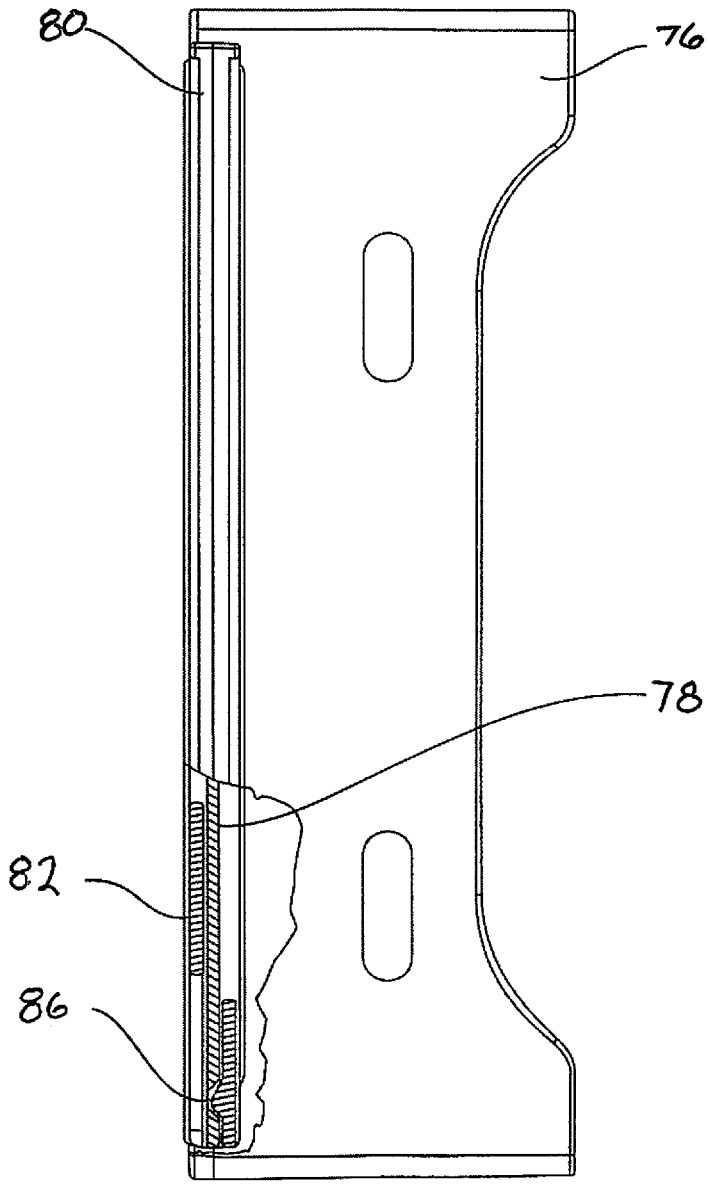
FIG. 13 is a partial cutaway, cross sectional top view of the third embodiment shelf divider.

Looking now at FIGS. 7 to 9, the fixed blade adjustable height shelf divider 40 (second embodiment shelf divider) can be seen in its unassembled and assembled states. Note that the fixed height blade 44 also has a vertical corrugated configuration with the open cell arrays formed there through as seen in the preferred embodiment. This fixed blade adjustable height shelf divider 40 consists of a separable blade support shelf bracket 42 and a fixed height blade 44. The assembled separable blade support shelf bracket 42 and fixed height blade 44 bear striking similarities to the lower blade base assembly 4 of the preferred embodiment described above. The blade support shelf bracket 42 is also C shaped bracket that has a top face that spans across the top of a shelf, two side arms that extend perpendicularly from the opposing short edges of the top face and extend across the shelf sides for the thickness of the shelf, and two return flanges that extend perpendicularly from the bottom edge of the side arms so as to extend partially along the bottom face of the shelf. However, it has a blade support socket 46 extending vertically upward from its top face. This socket 46 has a vertical pass through opening 48 and is conformed to match the horizontal cross sectional configuration of the vertically corrugated fixed blade 44. On either side of the socket is a footer recess 50. At the right and left ends of the socket 46 at the end of the pass through opening 48 are stabilizing grooves 60 that are matingly conformed to the stabilizing ridges 62 formed along the vertical edges of the fixed height blade 44. There are a series of stabilizing gusset tabs 52 spanning between the exterior vertical sides of the blade support socket 46 and the horizontal face of the blade support shelf bracket 42 to increase the rigidity of the socket 46.

The fixed height blade 44 is made in a variety of heights although each blade has the same footprint. The fixed height blade 44 has a pair of parallel vertical spring tabs 54 formed therein. (Although it is known that in alternate embodiments only one spring tab may be used.) These tabs have a normal position (a "thermoplastic set") that lies outside of the vertical plane of the section of corrugation that they reside in. The fixed height blade 44 also has a pair of horizontal footers 56 extending perpendicularly from its front and back bottom edges.

In operation, the top end of the fixed height blade is inserted through the socket 46 such that the stabilizing ridges 62 slide through the stabilizing grooves 60 and the horizontal footers 56 on the bottom of the fixed height blade 44 contact the footer recess 50 of the socket 46. At this vertical elevation, the spring tabs 54 of the fixed height blade 44 should extend outward so that their bottom edge contact the top edge of the socket 46, thereby locking the fixed height blade 44 into the blade support shelf bracket 42.

FIGS. 10 to 13 illustrate incremental blade shelf divider 70 (third embodiment shelf divider) in its unassembled and assembled states. The incremental blade shelf divider 70 has at least one upper fixed blade 72 that may be added to extend vertically from a support blade assembly 74. The support blade assembly 74 has a slidingly adjustable horizontal shelf bracket 76 identical to that of the preferred embodiment and a bottom blade 78 extending perpendicularly therefrom its top face. The bottom blade 78 and upper fixed blade 72 are both corrugated and have alternating series of vertical ridges and grooves and arrays of open cells formed there through. The height adjustment on this shelf divider is accomplished by sliding the bottom edge of the additive upper fixed blade 72 onto the top edge of the bottom blade 78 of the support blade assembly 74.

The slidingly adjustable horizontal shelf bracket 76 of the support blade assembly 74 is a C shaped bracket that has a top face that spans across the top of a shelf, two side arms that extend perpendicularly from the opposing short edges of the top face and extend across the shelf sides for the thickness of the shelf, and two return flanges that extend perpendicularly from the bottom edge of the side arms so as to extend partially along the bottom face of the shelf. In this fashion, the support blade base assembly 74 curves around a matingly conformed shelf, and holds the lower blade 10 perpendicular to the top surface of the shelf.

The top edge of the bottom blade has a horizontal, T shaped linear channel 80 traversing across its length (as does the top edge of the upper fixed blade). The bottom edge of the upper fixed blade 72 has a series of alternating connection tabs 82 matingly conformed to alternately engage the two sides of the T shaped linear channel 80. At one end of the linear channel 80 is a locking orifice 86 that is engaged by a lock protrusion 84 formed on one of the alternating connection tabs 82 to secure the horizontal location of the two blades relative to each other. Since the top edge of the upper fixed blade 72 also has the T shaped liner channel 80, multiple upper fixed blades 72 may be connected together to increase the vertical height of the shelf divider.

Each of the three embodiments of the horizontally and vertically adjustable shelf divider present low cost but different approaches to improving the efficiency of storing merchandise on commercially available shelves.

While certain features and aspects have been described with respect to exemplary embodiments, one skilled in the art will recognize that numerous modifications are possible. Moreover, system components described according to a particular structural architecture and/or with respect to one system may be organized in alternative structural architectures and/or incorporated within other described systems. Hence, while various embodiments are described with—or without—certain features for ease of description and to illustrate exemplary aspects of those embodiments, the various components and/or features described herein with respect to a particular embodiment can be substituted, added, and/or subtracted from among other described embodiments, unless the context dictates otherwise. Consequently, although three exemplary embodiments are described above, it will be appreciated that the invention is intended to cover all modifications and equivalents within the scope of the following claims.

Having thus described the invention, what is claimed as new and desired to be secured by Letters Patent is as follows:

1. A vertically, incrementally adjustable one-piece shelf divider having a lowered vertical configuration and a variable raised vertical configuration, comprising:

a lower blade base assembly having a slideable, adjustable horizontal shelf bracket and a lower blade which extends perpendicularly from a rear edge of a top face of said horizontal shelf bracket; and an, upper blade that is slidably constrained to said lower blade so as to make a one-piece shelf divider, and is incrementally vertically adjustable above a top edge of said lower blade;

wherein said lower blade is vertically corrugated, having a first alternating series of vertical ridges and grooves formed there across; and wherein said upper blade has a second alternating series of vertical ridges and grooves formed there across; and wherein said first and said second alternating series of vertical ridges and grooves make said upper blade and said lower blade matingly engageable;

wherein said upper blade and said lower blade reside adjacent and parallel to each other when said shelf divider is in the lowered configuration.

2. The vertically, incrementally adjustable one-piece shelf divider of claim 1 wherein said lower blade and said upper blade each have-an array of open cells formed therethrough.

3. The vertically, incrementally adjustable one-piece shelf divider of claim 2 wherein said horizontal shelf bracket is a C shaped bracket that has a top face that is adapted to span across the top of a shelf, two side arms that extend perpendicularly from a pair of opposing edges of said top face and are adapted to extend across a pair of shelf sides, and a pair of return flanges that extend perpendicularly from a bottom edge of said side arms so as to be adapted to extend partially along a bottom face of said shelf, such that said lower blade base assembly is adapted to wrap partially around a matingly conformed shelf, and is adapted to hold said lower blade perpendicular to said top surface of said shelf.

4. The vertically, incrementally adjustable one-piece shelf divider of claim 1 further comprising:

a linear series of vertical ratchet slots disposed along a vertical centerline of said lower blade; and a bendable ratchet tooth having a linear, planar strip body attached at a top end to said upper blade, having a bottom end free to flex horizontally so as to allow a tab extending from a front face, adjacent said bottom end, to engage said ratchet slots to lock a vertical position of said upper blade relative to said lower blade; and a tab at said bottom end of said ratchet tooth angled from a vertical plane of said ratchet tooth body to allow for a tactile ratchet disengagement manipulation.

5. The vertically, incrementally adjustable one-piece shelf divider of claim 4 further comprising:

a pair of vertical retention grooves formed continuously along a left vertical edge and a right vertical edge of said lower blade; and a pair of vertical slide edges on a right vertical edge and a left vertical edge of said upper blade, said slide edges having a thickness that is dimensioned for insertion and sliding movement within said vertical retention grooves.

6. The vertically, incrementally adjustable one-piece shelf divider of claim 4 further comprising:

a pair of parallel vertical slots formed in said lower blade between a bottom edge to a height below a top edge of said lower blade; and at least one T shaped tab extending perpendicularly from a front face of said upper blade; and wherein said T shaped tab is slidingly engageable within said vertical slot but retains said lower blade and said upper blade in a parallel corrugated configuration.

* * * * *